US005356085A

United States Patent [19]

Kobayashi et al.

[11] Patent Number: 5,356,085

[45] Date of Patent: Oct. 18, 1994

[54] METHOD AND APPARATUS FOR TREATING PACKAGE YARN END

[75] Inventors: Noriyuki Kobayashi; Masayuki Tamura, both of Matsuyama, Japan

[73] Assignee: Teijin Limited, Osaka, Japan

[21] Appl. No.: 22,686

[22] Filed: Mar. 1, 1993

[30] Foreign Application Priority Data

Mar. 3, 1992 [JP] Japan ..... 4-045539
Oct. 29, 1992 [JP] Japan ..... 4-291465

[51] Int. Cl.[5] ..... B65H 65/00

[52] U.S. Cl. ..... 242/18 R; 242/35.60 E; 242/164; 242/172

[58] Field of Search ..... 242/18 R, 18 EW, 35.6 E, 242/35.5 R, 159, 164, 165, 166, 167, 172

[56] References Cited

U.S. PATENT DOCUMENTS

| | | | |
|---|---|---|---|
| 1,527,751 | 2/1925 | Seyfarth | 242/18 EW |
| 3,110,450 | 11/1963 | Raasch | 242/18 EW |
| 4,384,689 | 5/1983 | Bloomfield et al. | 242/18 EW X |
| 4,760,969 | 8/1988 | Otoshima et al. | 242/18 R |
| 4,805,845 | 2/1989 | Fluck et al. | 242/18 EW |

FOREIGN PATENT DOCUMENTS

| | | | |
|---|---|---|---|
| 0257464 | 8/1987 | European Pat. Off. . | |
| 0299554 | 6/1988 | European Pat. Off. . | |
| 187936 | 8/1907 | Fed. Rep. of Germany | 242/18 EW |
| 195570 | 2/1908 | Fed. Rep. of Germany . | |
| 9114627 | 11/1991 | Fed. Rep. of Germany . | |
| 63-57477 | 3/1988 | Japan . | |
| 338188 | 6/1991 | Japan . | |

*Primary Examiner*—Stanley N. Gilreath
*Attorney, Agent, or Firm*—Burgess, Ryan and Wayne

[57] ABSTRACT

Method and apparatus for picking up an yarn end so as to fix the same on a yarn package comprising picking up an yarn end from a yarn package by a suction means so as to hold the yarn end therein in a drawn state, inserting an yarn end handling bar between the held yarn end and the package surface, revolving the yarn end handling bar along the package surface while maintaining the bar beneath an outermost layer yarn connected to the yarn end until a layered portion is formed, in which the end yarn held in a drawn state coincides with the outermost layer yarn, and ejecting a jet of pressurized fluid onto or in the vicinity of the layered portion so as to entangle the yarn end with the outermost layer yarn so that the yarn end is fixed on the package.

Method and apparatus for treating a package end yarn when the yarn end is released from an entangled portion, in which the yarn end is entangled and fixed with an outermost yarn layer of a package comprising drawing the outermost yarn layer so as to float the same above the package surface with both ends thereof continuing to the package, severing the floating outermost layer yarn from the package at a portion on one side thereof, rotating the package in the unwinding direction so as to draw the other portion of the outermost yarn layer, severing the outermost yarn layer from the package at a portion on the other side thereof, and rotating the package in the winding direction so as to withdraw a fresh end yarn.

7 Claims, 9 Drawing Sheets

METHOD AND APPARATUS FOR TREATING PACKAGE YARN END

BACKGROUND OF THE INVENTION

1. Field of the Invention

The present invention relates to the treatment of a package yarn end, more specifically to a method and apparatus for fixing a package yarn end on the outermost layer of a yarn package so as to prevent hanging or disordered yarn end during the transportation of the package and to facilitate the pickup of the yarn end during a peel-off operation of the outermost layer of the package, and a method and apparatus for picking up the thus-fixed yarn end on the outermost layer of the package and releasing the same from the tied or entangled state so as to facilitate the operation carried out in the subsequent process.

2. Description of the Related Art

Recently, in processes for producing synthetic fibers, such as polyester fibers, trials have been conducted for automating the peel-off operation of the package outermost layer, hitherto carried out manually, so as to improve production efficiency. Serious problems exist in the automation of this operation, in that hanging or disordered yarn ends occur because of the turbulent of air stream emitted from the air-conditioner when transporting the doffed package or because of package vibration, which prevent the yarn end from being picked up.

To solve such problems, there have been various proposals, such as a method in which a yarn end is fixed at a finished stage of the package exchange by the same sizing oil as used in a yarn spinning process (Japanese Examined Patent Publication (Kokoku) No. 3-38188) or a method in which a yarn end is entangled with the outer surface of the package by a high pressure jet ejected from a nozzle (Japanese Unexamined Patent Publication (Kokai) No. 63-57477).

According to the above methods, it is possible to fix a package yarn end and eliminate hanging or disordered yarns during transport.

However, the method using the sizing oil has a drawback in that lack of uniformity may occur during the dyeing operation due to irregular distribution of sizing oil, while the method relating to the entanglement of a yarn end with the package surface has a drawback in that the area in which yarn quality cannot be guaranteed is widened in accordance with the location of the entangled portion or nozzle pressure, or the yarn end may be embedded in the package, thereby rendering a yarn end pick up operation impossible.

As stated above, in the prior art, while the yarn end is fixed by entanglement thereof with the package outer surface so as not to be disordered, this entanglement state must be rectified and restored to a normal yarn state prior to proceeding to a subsequent process. This releasing operation, however, requires excessive labor and time as it is executed manually.

SUMMARY OF THE INVENTION

It is an object of the present invention to solve the above problems inherent in the prior art and provide a method and apparatus for stably and assuredly restoring a hanging or disordered package yarn end during the transportation of the package as well as a method and apparatus for picking up the restored package yarn end and releasing the same so that the package can be transported to a subsequent process while maintaining a stable yarn end state.

According to a first aspect of the present invention, a method is provided for picking up a yarn end and fixing the same on a yarn package, comprising the steps of picking up a yarn end from a yarn package by a suction means so as to hold the yarn end therein, inserting a yarn end handling bar between the held end yarn and the package surface, revolving the yarn end handling bar along the package surface while maintaining the bar beneath an outermost layer yarn connected to the yarn end until a layered portion is formed, in which the yarn end held coincides with the outermost layer yarn, and ejecting a jet of pressurized fluid onto or in the vicinity of the layered portion so as to entangle the yarn end with the outermost yarn layer so that the end yarn is fixed on the package.

According to a second aspect, an apparatus is provided for picking up a yarn end and fixing the same on a yarn package, comprising a bobbin holder for holding a yarn package connected with a driving means for rotating the bobbin holder together with the yarn package; a yarn end holding bar arranged parallel to the bobbin holder and adapted to revolve around the bobbin holder by a driving means so that an outermost layer yarn of the package held by the bobbin holder is partly separated from the package surface to form a portion layered with the yarn end; a suction means associated with the bobbin holder for picking up the yarn end from the package surface and holding the same; and a fluid treatment means movable in the direction closer to and away from the bobbin holder, for entangling and fixing the yarn end with the outermost yarn layer separated from the package surface.

According to a third aspect of the invention, a method is provided for treating a package yarn end when the yarn end is released from an entangled portion, in which the yarn end is entanged and fixed with an outermost yarn layer of a package, comprising the steps of drawing the outermost layer yarn so that it floats above the package surface with both ends thereof continuing on the package; severing the floating outermost yarn layer from the package at a portion on one side thereof; rotating the package in an unwinding direction so as to draw the other portion of the outermost layer yarn; severing the outermost layer yarn from the package at a portion on the other side thereof, and rotating the package in the winding direction so as to withdraw a fresh yarn end.

According to a fourth aspect, an apparatus is provided for treating a package yarn end when the yarn end is released from an entangled portion, in which the yarn end is entangled and fixed with an outermost layer yarn of a package, comprising a tray for carrying a package thereon, a conveyor for transporting the tray, a yarn end releasing mechanism, and a package revolving mechanism; both mechanisms being arranged on the respective sides of the conveyor while confronting each other; the yarn end releasing mechanism comprising a suction nozzle movable down toward the package; yarn cutters arranged on both sides of the suction nozzle and movable about the suction nozzle; and a detector placed in front of the suction nozzle so as to be movable downward from the suction nozzle, for determining whether or not the drawn yarn exists.

BRIEF DESCRIPTION OF THE DRAWINGS

The present invention will be described in more detail with reference to the preferred embodiments illustrated in the drawings, wherein.

DETAILED DESCRIPTION OF THE PREFERRED EMBODIMENTS

Figure 1:
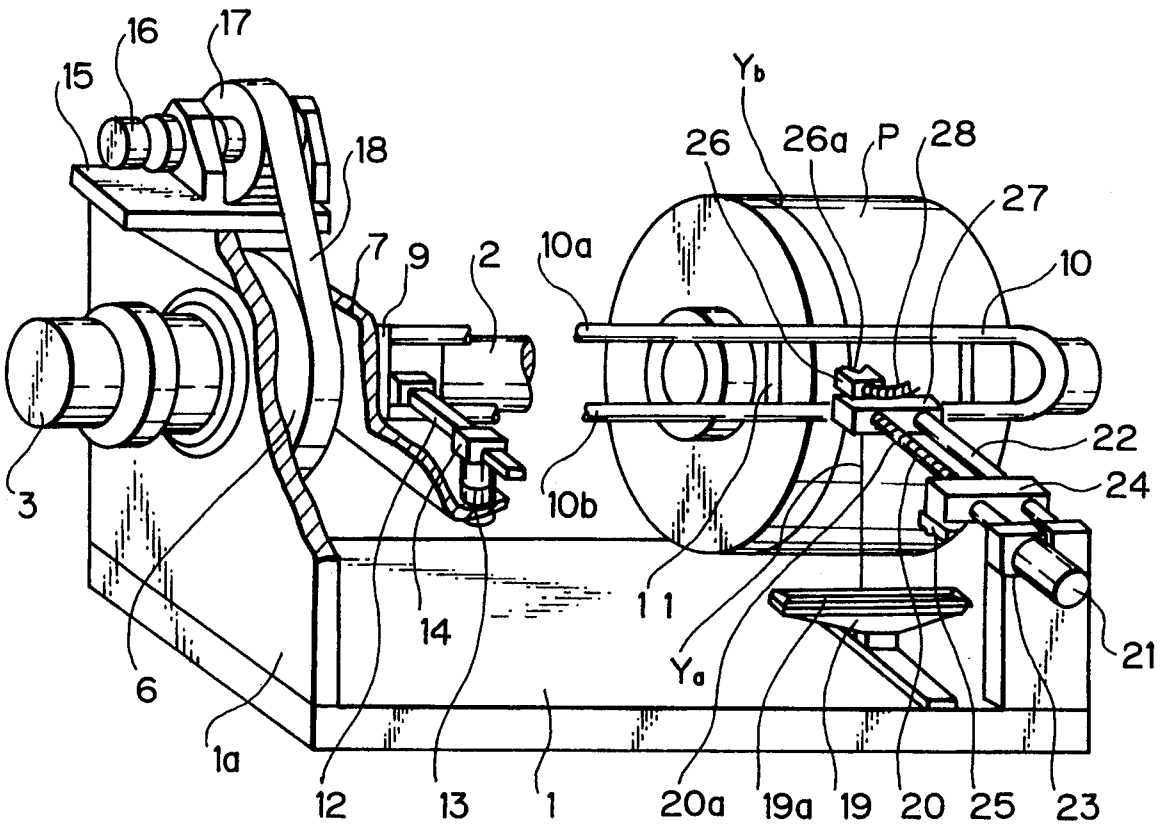
FIG. 1 is a diagrammatic perspective view of an apparatus for executing a fixation of a package yarn end according to the present invention.
Figure 2:
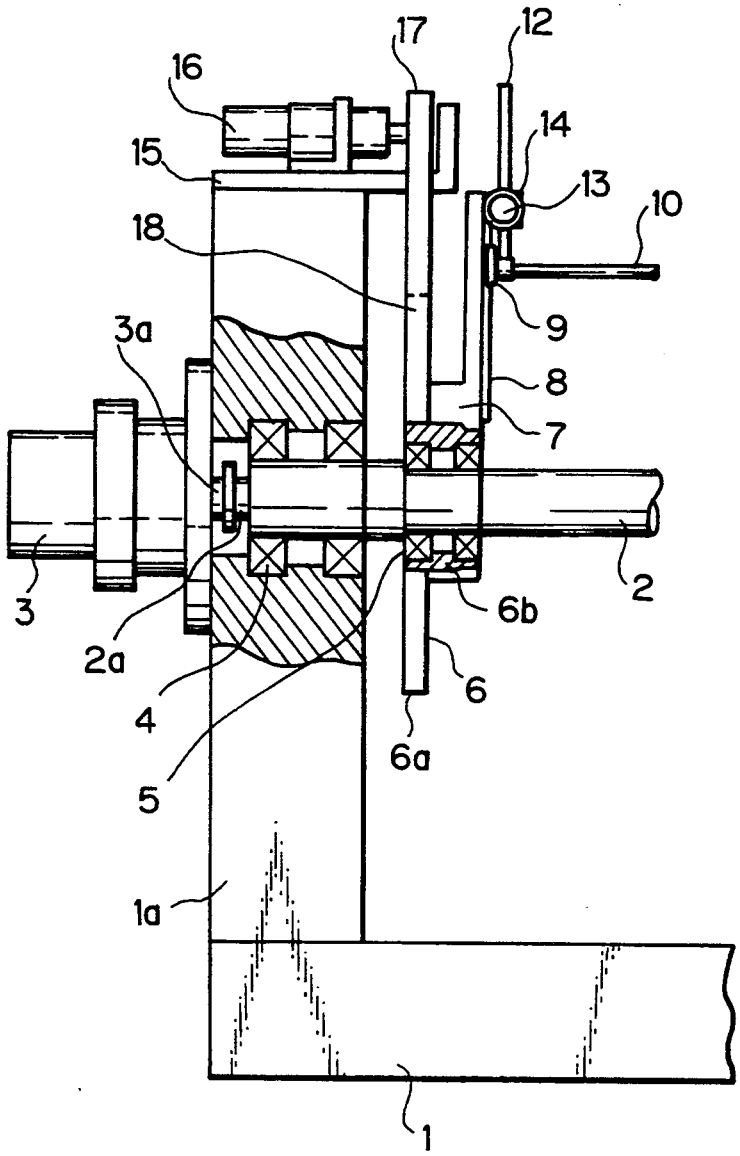
FIG. 2 is a partial sectional plan view explaining a mounting structure for a yarn end handling bar.

In FIGS. 1 and 2, a vertical plate la is fixed on a machine frame 1, on which a holder 2 for supporting a yarn package P is mounted via a bearing 4 so that the bobbin holder 2 is connected at the rear end 2*a* with a driving shaft 3*a* of a motor 3 fixed on the vertical plate la and driven thereby.

A pulley 6 is rotatably secured onto the rear portion of the bobbin holder 2 via a bearing 5. A guide plate 7 for supporting a yarn end handling bar 10 parallel to a rim 6*a* of the pulley 6 is fixed on a boss 6*b* at the front side of the pulley 6 so that the guide plate 7 extends parallel to the rim 6*a*.

A slider 9 is slidably engaged with a slider guide 8 formed on the front surface of the guide plate 7 via a linear bearing or the like, and a yarn end handling bar 10 (twin shaft) is mounted on the slider 9 provided with a pair of rods 10*a*, 10*b* extending parallel to each other toward the tip end of the bobbin holder 2. The rods 10*a*, 10*b* are arranged at a predetermined distance therebetween and positioned in an upper/lower relationship in FIG. 1. A geared rack 12 is provided on the slider 9 while extending parallel to the guide plate 7 and vertical to the yarn end handling bar 10. In this regard, while the pair of rods 10*a* and 10*b* may be structured either as an integral body or as separate bodies, they are preferably connected to each other by spacer (reinforcement) members 11. Further, the rods 10*a*, 10*b* and the spacer members 11 may have a tubular body in place of a solid body.

A motor 13 having a pinion on a driving shaft thereof is fixed to the outer end of the guide plate 7, so that the pinion meshes with the rack 12 in a gear box 14 fixed onto the upper wall of the motor 13. According to this structure, the yarn end handling bar 10 can be displaced close to and away from the bobbin holder 2 (yarn package P) through the linear motion of the rack 12 driven by the motor 13. This displacing structure is very favorable because the yarn end handling bar can be positioned relative to the package in accordance with the package diameter, and it is widely applicable to packages of various types or those having different diameters. However, if the package to be treated always has the same diameter, this structure is not necessary.

A motor 16 is positioned on the vertical plate 1*a* via a bracket 15. A belt 18 is wrapped between a pulley 17 fixed on a driving shaft of the motor 16 and the pulley 6 (rim 6*a*) fixed on the rear portion of the bobbin holder 2 so that the pulley 6 is driven by the motor 16 so as to revolve the yarn end handling bar 10 fixed on the pulley 6 around the bobbin holder 2.

On the machine frame 1 beneath the righthand portion of the bobbin holder in FIG. 1 is provided a yarn end holding nozzle 19 with a suction mouth 19*a* having a length corresponding to the width of the package P. Above the nozzle, at a position corresponding to the rear or the side of the nozzle, a motor 21 connected with a screw shaft 20 extending toward the package P is provided together with a bracket 23 for supporting a guide shaft 22 arranged parallel to the screw shaft 20. A pedestal 24 for supporting the screw shaft 20 and the guide shaft 22 is provided in front of the bracket 23 via a bracket 25. A bearing is arranged on the pedestal 24 for supporting the screw shaft 20. In this regard, a screw 20*a* is provided on the screw shaft 20 from the pedestal 24 to the tip end of the shaft 20.

A movable body 27, on which an entanglement nozzle 26 for fixing a yarn end is mounted in a projecting manner, is screw-engaged with the screw shaft 20 and is loosely fitted with a guide shaft 22 so as to be displaceable in the forward/rearward direction by the rotation of the screw shaft 20 while guided by the guide shaft 22, whereby the entanglement nozzle 26 is displaceable into the yarn end handling bar 10. While the entanglement nozzle 26 preferably has a U or V shaped inlet slit 26*a* for facilitating the introduction of a yarn into an entanglement groove or aperture, in which a jetting orifice is opened, it should be noted that the present invention is not restricted to such a structure. In addition, while the screw shaft is used for displacing the entanglement nozzle 26 in this embodiment, other known means, such as a power cylinder or a slider may be used for the same purpose.

Reference numeral 28 represents a fluid supplying conduit connected with the jetting orifice.

Other means may be adopted to revolve the yarn end handling bar 10 along the periphery of the package P. Also a gripping mechanism of the bobbin holder 2 may be any type including a spring type or a compressed air type, the detailed description of which is eliminated in this specification because such a structure is publicly known in the art.

A yarn package P transferred from a yarn take-up machine or a carrier is fitted to the bobbin holder 2 on the machine frame of the thus-structured apparatus and fixed thereon by a non-illustrated chuck mechanism in an unstable state while the yarn end thereof is disordered or separated.

After the package P has been fixed, the yarn end holding nozzle 19 is operated so as to generate a suction stream so that the suction mouth 19*a* attains a suction state. Simultaneously therewith, the motor 3 is driven so as to rotate the package P fixed on the bobbin holder 2 one through several turns. At this stage, the motor 3 is preferably made to rotate in reverse so that the yarn end Ya is prepared for being drawn. In this connection, the suction mouth 19*a* may be connected with a slide mechanism for facilitating the drawing and fixing operation of the yarn end.

Figure 3A:
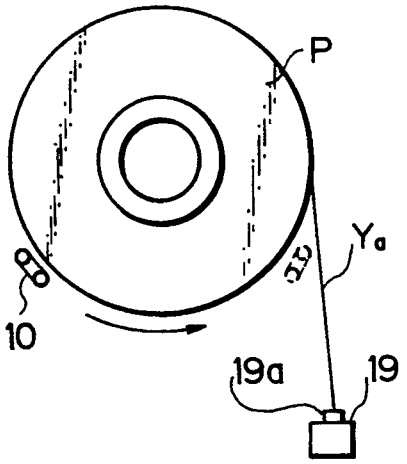
FIGS. 3*a* through 3*f* are schematic views explaining an operational sequence of the apparatus shown in FIGS. 1 and 2.

According to this rotation, the yarn end Ya is withdrawn from the package P when it passes the vicinity of the suction mouth 19*a* and is held thereby. At this stage, the yarn end handling bar 10 is retreated to a position so as not to interfere with these operations (see FIG. 3*a*).

Figure 3B:
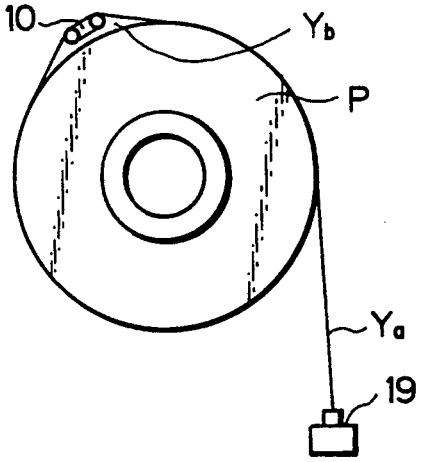
Figure 3C:
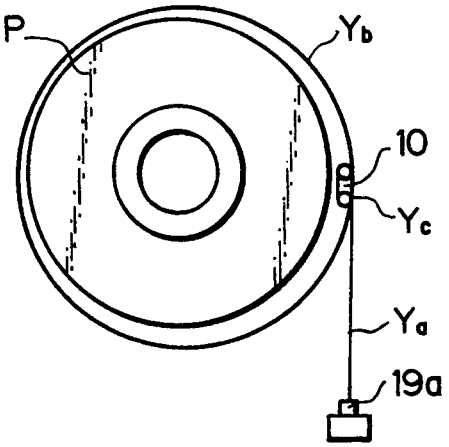

After the yarn end Ya has been fixed, the motor 16 is driven so as to rotate the pulley 6 via the belt 18. The yarn end handling bar 10 fixed on the slider 9 is inserted beneath the yarn end Ya held by the suction mouth 19*a*, as shown by dotted lines in FIG. 3*a*. The yarn end handling bar 10 is inserted by substantially one through several revolutions (FIG. 3*b*) beneath an outermost yarn layer Yb corresponding to one turn or more of yarn length while peeling the same from the package surface and forming a yarn portion Yc layered on the yarn end Ya (see FIG. 3*c*).

Figure 3D:
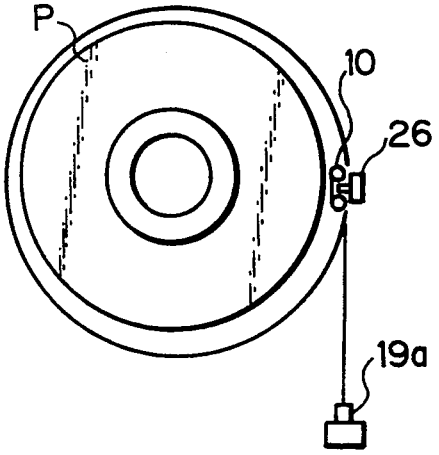

Next, after the yarn end handling bar 10 has been stopped, the entanglement nozzle 26 enters between both rods 10*a*, 10*b* in accordance with rotation of the screw shaft 20 (see FIG. 3*d*); the layered yarn portion Yc is introduced while guided by the V shaped inlet slit 26*a* into the entanglement aperture, in which the two layered yarn lengths are subjected to an entanglement treatment by the ejection of an operating fluid, and can be very easily fixed to each other. Thus, the yarn end Ya is entangled with the outermost layer yarn Yb and fixed therewith. In this case, since a gap is always formed between both rods 10*a* and 10*b* of the yarn end handling bar 10 so that the yarn portion Yc layered on the yarn end Ya is assuredly floated from the package P, the entanglement nozzle 26 can easily enter the gap so as to carry out the entanglement operation in a stable manner.

Figure 3E:
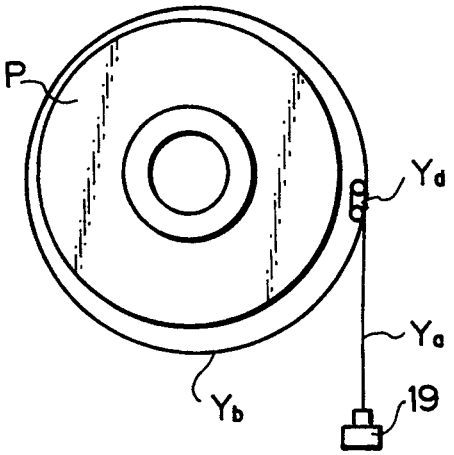

After the yarn end has been fixed by the formation of an entangled portion Yd, the entanglement nozzle 26 stops the suction operation and simultaneously therewith retreats to a position not interfering with the package P, whereby the yarn end is released from the suction mouth 19*a* (FIG. 3*e*).

In this case, the yarn end is preferably severed between the entangled portion Yd and the suction mouth 19*a* by a suitable cutting means, such as a sharp edge or a heated blade.

Figure 3F:
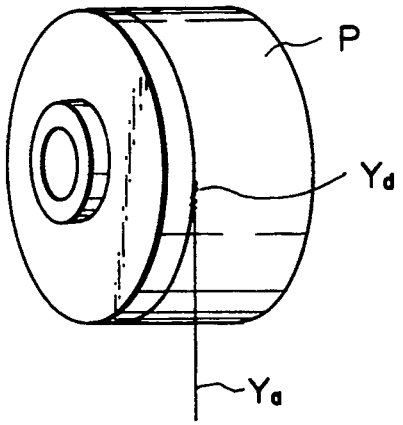

As shown in FIG. 3*f*, the package P, on which the end yarn has been fixed, is displaced to a predetermined location and, after the grip of the bobbin holder 2 has been released, is transferred to a suitable carrier by an automated means, such as a pushing plate operated by a power cylinder mounted on the machine frame 1 or a robot.

After the package has been transferred to the carrier, the yarn end handling bar 10 returns to a position not interfering with a package P to be treated in a subsequent cycle. Thus, one cycle of steps of the yarn fixing operation is completed.

Figure 4:
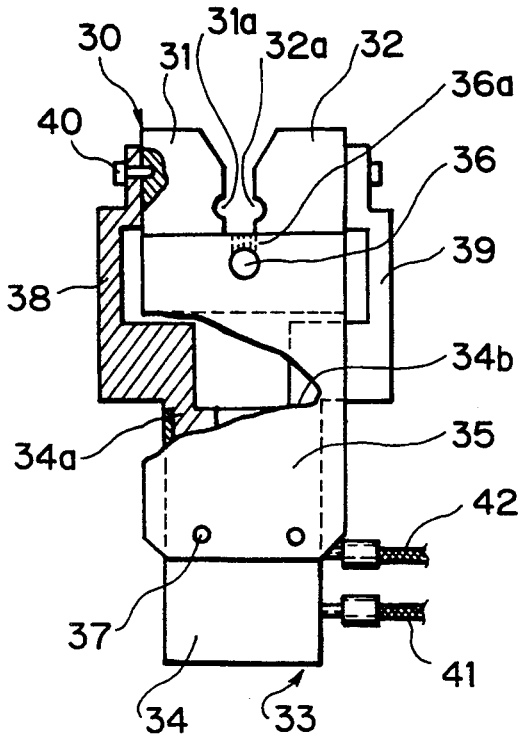
FIG. 4 is a partial sectional plan view of an entanglement nozzle according to the present invention.

If the entanglement nozzle is an integral type, even though a V shaped inlet slit 26*a* would be formed, the width thereof cannot be very large. In such a case, if the yarn deviates from the regular position, the yarn may not be guided by the slit at all or correctly introduced into the entanglement aperture, whereby stable yarn entanglement cannot be expected or the yarn may be damaged when the nozzle is displaced backward after the yarn entanglement has been completed. To avoid such drawbacks, a divided open/close type entanglement nozzle, shown in FIG. 4, is preferably used.

That is, in the drawing, a nozzle body 30 consists of a pair of halves 31 and 32, each of which is fixed by a bolt 40 to a bracket 38 or 39 projected from a hook 34*a* or 34*b* of a fluid pressure chuck 33.

The fluid pressure chuck 33 is adapted to laterally displace the hooks 34*a* and 34*b* subjected to an open/close motion using a cylinder/cam mechanism or a cylinder/link mechanism (not shown) provided in a chuck body 34. The halves 31, 32 can slide along a front edge of a guide body 35 fixed on the upper wall of the chuck body 34 by bolts 37. Each of the halves 31, 32 has a semicircular groove 31*a* or 32*a* that forms a circular or oval yarn guiding hole when the halves 31, 32 are closed, and has an oblique front wall, thereby forming a diverging V shaped guide.

The operating fluid of the entanglement nozzle is supplied to an inlet hole 36 provided on the front part of the guide body 35, to a connecting hole 36*a* formed at the end of the inlet hole 36 and then to a supply hole (not shown) provided in the nozzle body 30 corresponding to the connecting hole 36*a*. (Note that when the halves 31, 32 are closed, these holes coincide with each other.) Reference numerals 41, 42 represent, respectively, a supplying conduit and a discharging conduit for the operating fluid.

When the nozzle body 30 in the open state moves to the package and the yarn to be subjected to the entangling treatment reaches a position corresponding to the yarn guiding hole, the chuck 33 is actuated so as to close the halves 31, 32, the operating fluid is supplied and the entangling operation is started. At this time, since the yarn guiding hole is completely closed, any problems, such as jumping-out of the yarn during the entangling operation, can be avoided. Even if the yarn deviates from the regular position, since the nozzle moves in the open state so that the clearance becomes larger, the yarn positioning is more easily carried out because the deviation can be absorbed by the increased clearance. Further, since the chuck is in the open state when the nozzle retreats to the original position after the entangling operation has been completed, interference of the chuck with the entangled and fixed yarn can be avoided.

It is needless to say that the positioning of the entanglement nozzle or the chuck can be more accurately carried out by detecting the moving distance by means of a distance sensor or the like.

The package on which the yarn end has been fixed by the entangling treatment, as stated above, is removed from the bobbin holder by a removal means. At this stage, the outermost layer yarn containing the entangled portion is in contact (engaged) with the yarn end handling bar positioned between the entangled portion and the package. Accordingly, when the removal of a package is carried out while the yarn is in contact with the bar, the outermost layer yarn containing the entangled portion is forced to deviate from the regular position.

If such a positional deviation exists in a certain kind of yarn package, the yarn may stretch and yarn end pick-up operation may be difficult. Particularly, when the outermost layer yarn containing the entangled portion is positioned at a package end nearer to the yarn end fixing apparatus, the outermost layer yarn containing the entangled portion may drop down from the package end or is liable to drop down due to vibration during the transportation of the package, whereby the yarn end may not always be fixed at a predetermined position on the package.

Figure 5:
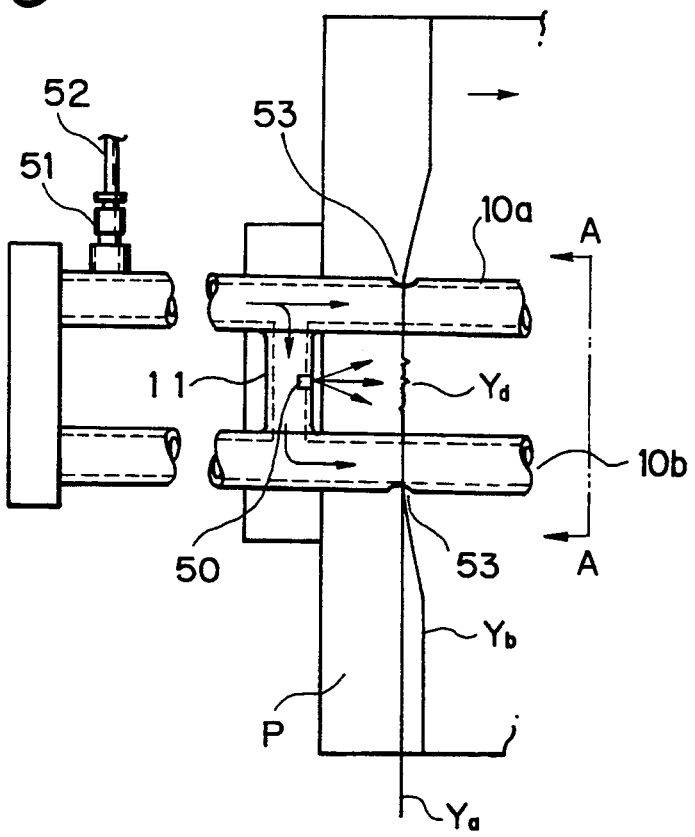
FIG. 5 is a schematic view explaining the operation for preventing the displacement of an entangled portion of a yarn end using compressed air according to the present invention.
Figure 6:
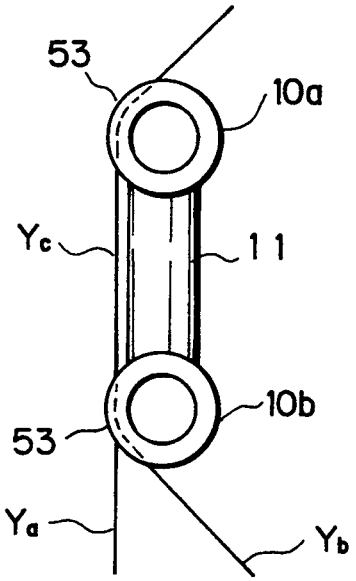
FIG. 6 is a sectional view along A—A line of FIG. 5.

To avoid such problems, the treatment using pressurized fluid is favorable, as shown in FIG. 5. That is, in FIG. 5, the yarn end handling bar 10 is constructed by tubular members, in which the spacer member 11 has an orifice 50 for ejecting pressurized air slightly upward while directed to the entangled portion Yd. A plurality of spacer members 11 are provided. In this embodiment, six members 11 are provided, each having the orifice 50, and although such an arrangement is preferable, only a front top group of the spacer members may have the respective orifice. The orifice 50 may be of various types including a slit type and a linearly arranged aperture type.

An inlet port 51 communicates with a pressurized air source through a conduit 52. The pressurized air is supplied to the inlet port 51 and ejected from the orifice 50 when the package P is removed from the bobbin holder 2. The ejected air impinges onto the outermost layer yarn containing the entangled portion Yd so as to push back the same so that the positional deviation thereof caused by the displacement of the package does not occur. Since the entangled portion is maintained substantially at a regular position, the aforesaid problem can be avoided and the stable yarn end fixation is obtainable. The pressure and the amount of ejected pressurized air may be constant irrespective of the kind of yarn used but are preferably selected to be suitably predetermined values in accordance with the kind of yarn used.

In addition, it is preferable to provide a yarn restricting groove 53 for guiding the yarn portions Ya, Yb and Yc or positioning the same at a specified position. According to the provision of the yarn restricting groove 53, the separation of yarns in the layered yarn portion Yc due to the yarn slip is prevented so that stable formation of the yarn layered portion can be ensured.

The above description is made for the case when only one package is treated for ease of understanding the present invention. However, it is usually preferable to simultaneously treat a plurality of (six, for example) packages. For this purpose, a plurality of the above mechanisms are provided while corresponding to individual packages or combined as a single unit. The yarn end fixing operation may be carried out by any other yarn entangling means than that described above, such as a texturizing nozzle for the production of a Taslan yarn or the like.

Moreover, the yarn end handling bar, the entanglement nozzle or other members or mechanisms may be associated with a means for automatically adjusting and/or controlling a displacement position of the former in accordance with package size (diameter), for example, by using various sensors and controlling the displacement range.

The motor used in the present invention is not limited to an electric motor but may be other types such as a rotary actuator using pressurized air.

A method for fixing a yarn end according to the present invention described above may be executed when the package is doffed from a yarn take-up machine by an apparatus provided on or beside a doffer. It is needless to say that this method may also be applied to a package treatment process or the like.

The package on which the yarn end has been fixed by entanglement thereof with the outermost layer yarn is transported to a subsequent process while usually being transferred to a conveyor tray. It is necessary to release the fixing state of the yarn end so as to be in a free but stable state after transporting and prior to introduction to a subsequent process. This releasing operation is carried out using the following apparatus.

Figure 7:
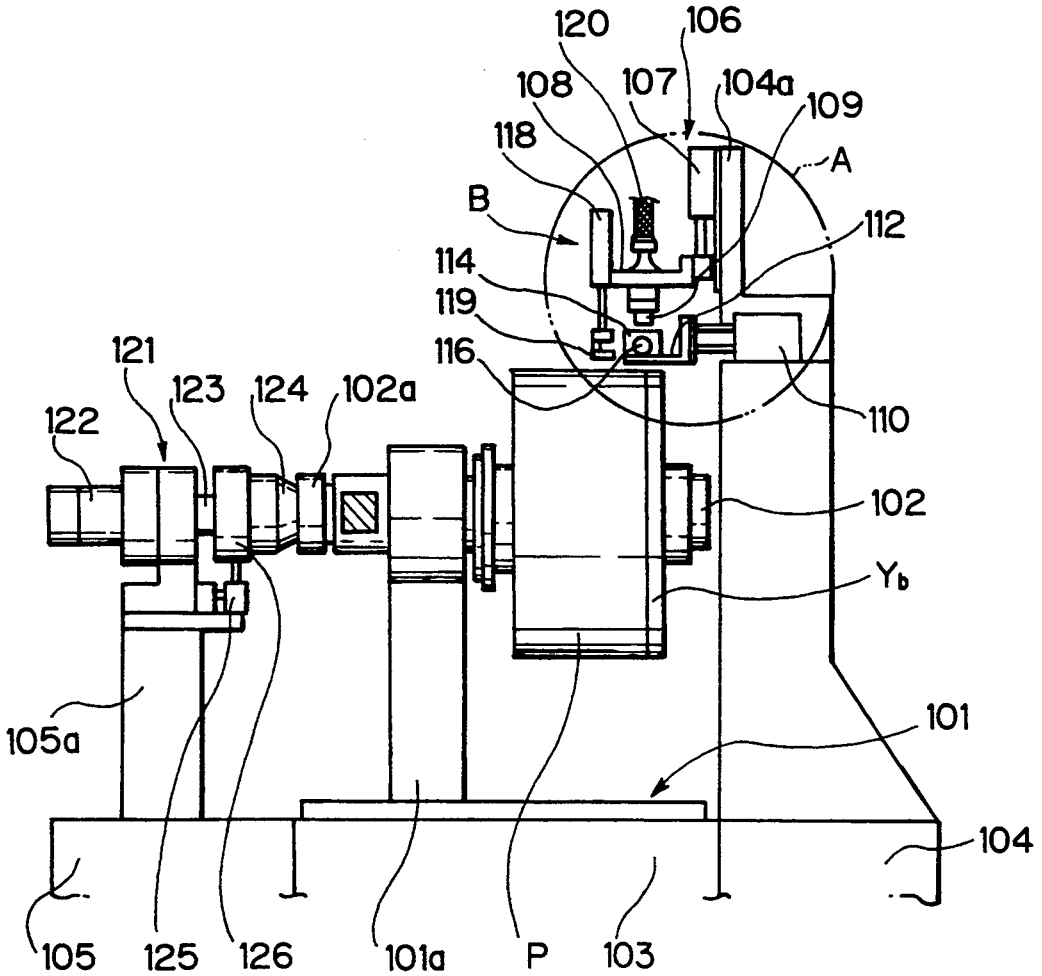
FIG. 7 is a side elevational view of an apparatus for executing a releasing operation for the fixed yarn end according to the present invention.
Figure 8:
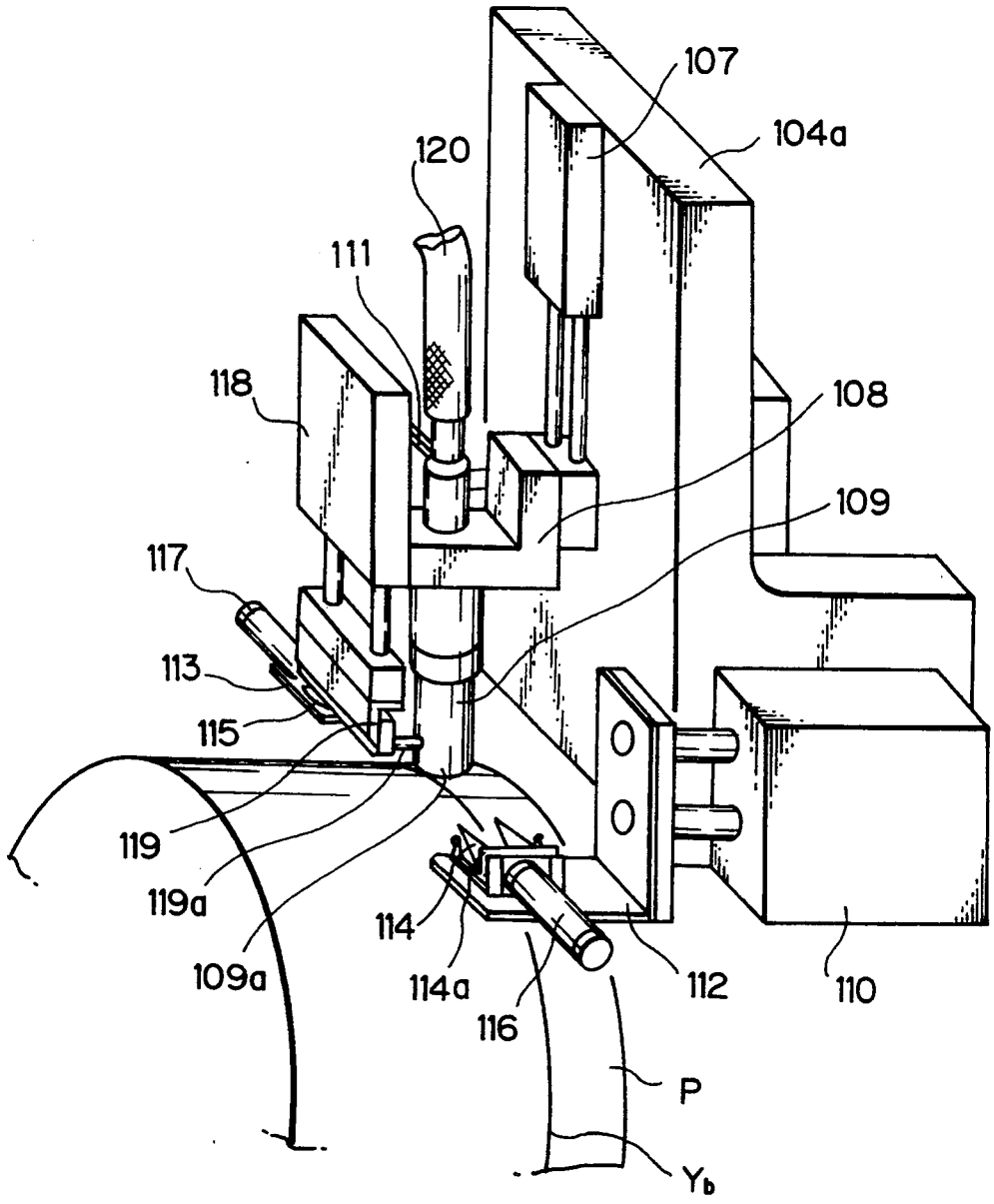
FIG. 8 is an enlarged perspective view of A part of FIG. 7.
Figure 9:
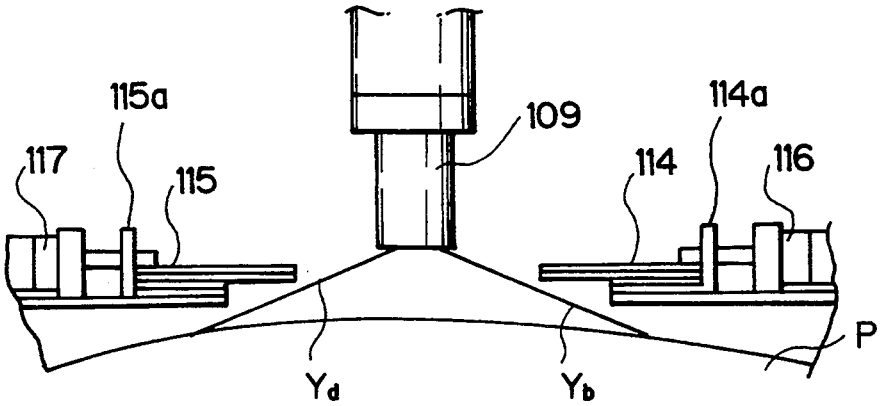
FIG. 9 is an enlarged front view of B part of FIG. 7.

FIG. 7 is a side elevational view of an apparatus for executing a releasing operation for the fixed yarn end, FIG. 8 is an enlarged perspective view of A part of FIG. 7, and FIG. 9 is an enlarged front view of B part of FIG. 7. While the following description is made in the case when the yarn end is fixed by the entanglement, the present invention should not be limited to such a case.

A conveyor tray 101 is provided with a horizontal bobbin holder 102 for holding a yarn package P thereon. The bobbin holder 102 fixedly holds the package P by a known means, such as a spring type, while rotatably supported on a main body 101*a* of the tray. A connecting member 102*a* consisting of a receiver for a taper sleeve of a bearing unit is mounted to the rear end of the bobbin holder 102 for transmitting the rotation to the bobbin holder.

A conveyor 103 is provided for transporting the tray to a predetermined place while placing the tray thereon. Machine frames 104 and 105 are arranged while intervening the conveyor 103 therebetween. An yarn end releasing mechanism 106 is provided on the machine frame 104, and a package revolving mechanism 121 is provided on the machine frame 105 for rotating the bobbin holder 102 at a predetermined angle.

In the yarn end releasing mechanism, on the vertical front surface of a bracket 104*a* is fixed a power cylinder 107, to which a suction nozzle 109 is mounted via a supporting member 108, while a suction mouth 109*a* thereof is directed downward. Beneath the suction nozzle 109, scissor-like cutters 114 and 115 fixed on vertical side surfaces of brackets 114*a*, 115*a* (the latter is not shown) are arranged in a relatively confronting manner on opposite sides of the suction nozzle 109, via brackets 112, 113 and power cylinders 110, 111. A scissor part of the respective cutter is mounted to a power cylinder 116 or 117 so that it is reciprocatingly displaceable toward/away from the mating cutter.

A pair of yarn end photodetectors 119, 119 (only one is illustrated) are mounted on the supporting member 108 by a power cylinder 118 so as to be displaceable in the up-down direction. Each of the sensor parts 119*a* thereof is directed to a vertical front surface of the bracket 104*a* and positioned between the cutter 114 or 115 and the suction nozzle 109. Reference numeral 120 represents a suction hose.

The package revolving mechanism 121 provided on the other side of the conveyor 103 is fixed on the pedestal 105*a* so that an axis thereof is in line with that of the package P. The package revolving mechanism 121 comprises a driving motor 122 (usually an air type, but may be other types such as an electric motor), a driving shaft 123, a taper sleeve 124 attached to a tip end of the driving shaft 123 and directly connected with the connecting member 102*a*, and a pusher 126 pushing so as to press the taper sleeve 124 onto the connecting member 102*a* by a power cylinder 125. The taper sleeve 124 is fitted to the driving shaft 123 so as to be displaceable in the axial direction by a known means, such as a spline or axially formed grooves, but should not be restricted to such means. The pusher 126 and the taper sleeve 124 are engaged to each other via a rolling bearing provided in either one of the two so that the sleeve 124 is rotatable while being pushed by the pusher 126. Alternatively, the package revolving mechanism 121 itself may be displaced by a power cylinder so as to achieve the above connection.

Figure 10A:
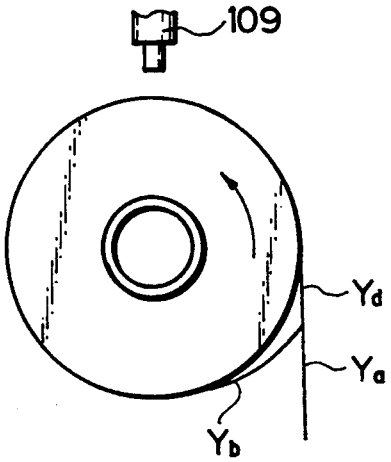
FIGS. 10*a* through 10*f* are schematic views explaining an operational sequence of the apparatus shown in FIGS. 7, 8 and 9.

The package P on which the yarn end Ya has been fixed by the entangling treatment is transported from the preceding process by the conveyor 103. Upon reaching a position in front of the above apparatus, the package P is stopped and precisely positioned by the action of a stop (not shown) fixed at a predetermined position. The yarn end Ya is in a fixed state on the outer surface of the package P by entanglement with the outermost yarn layer carried out in the preceding process. As shown in FIG. 10*a*, the outermost yarn layer Yb containing the entangled portion Yd, in which the yarn end Ya is fixed, is in a partially slackened state while the yarn end Ya is hanging down by the force of gravity.

When the positioning has finished and the tray 101 has been fixed, the power cylinder 125 is actuated so as to slide the taper sleeve 124 in the arrowed direction and fixedly connect the same with the connecting member 102*a*, whereby the package P is rotatable by the driving motor 123.

Figure 10B:
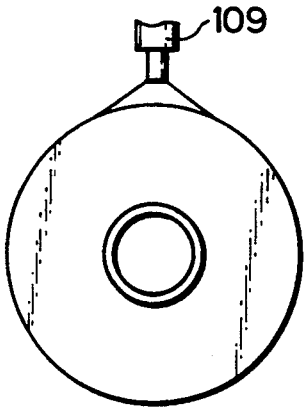

Next, the power cylinder 107 is actuated so as to lower the suction nozzle 109. Thereby, the suction nozzle 109 approaches a peripheral area of the package outer surface in which the entangled portion Yd exists, and initiates the suction. Simultaneously with the suction, the package P is made to rotate in the yarn winding direction shown by an arrow (but the direction may be reversed), during which the entangled portion Yd is picked up and drawn in (FIG. 10*b*). If the entangled portion Yd is positioned at a predetermined location, the amount of package rotation necessary for yarn pick-up may be somewhat larger than that necessary for attaining this location. However, if the location of the entangled portion Yd is indefinite, the package P is made to rotate at least one turn. In this connection, if an increase in the drawn yarn waste is allowable, the suction nozzle 109 may be initially positioned at any location of the package outer surface, provided the outermost yarn layer can be floated by the suction.

When the package P is made to rotate by the predetermined turn, the yarn end detectors 119 are lowered by the power cylinder 118 to a position in the vicinity of the suction mouth 109*a* forming a yarn suction passage so as to determine whether or not the yarn end is drawn in. If the determination is negative, the process returns to the first step and repeats the same sequence as before. Alternatively, an alarm or the like may be additionally issued or the sequence may be interrupted after the alarm is activated.

Figure 10C:
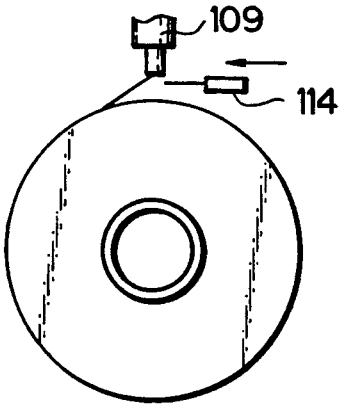
Figure 10D:
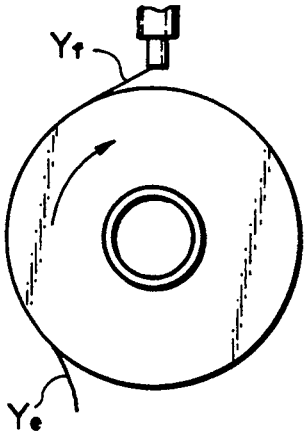

If the determination is affirmative, that is, if the suction of the yarn end has been confirmed, the cutter 114 is projected to a position corresponding to the outermost yarn layer Yb by the action of the power cylinder 110, and the scissor part 114*a* moves toward the suction nozzle 109 by the action of the power cylinder 116 and shuts its blade so as to sever the drawn yarn (on the side of yarn end Ya) (see FIGS. 10*c, d*). After one side of the yarn has been severed, the motor 122 is reversed so as to rotate the package P in the unwinding direction (the direction in which the yarn is unwound) so that the severed portion Ye is drawn and peeled off (see FIG. 10*d*).

Figure 10E:
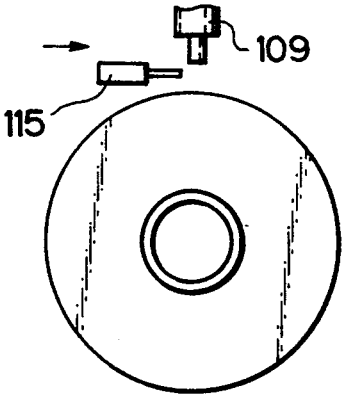
Figure 10F:
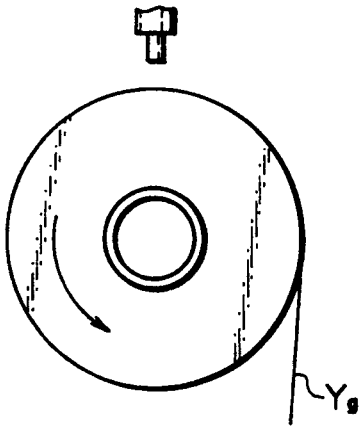

After a predetermined amount of the outermost yarn layer has been removed by suction, while connected to the other side yarn Yf maintained in a drawn state and during the predetermined rotation of the package, the power cylinders 111, 117 are actuated so as to operate the other cutter 115 in a similar manner as described above so as to sever the yarn held by suction (see FIG. 10*e*). The package P is then made to rotate in the yarn winding direction so that a new yarn end Yg having a predetermined length hangs down from the package (see FIG. 10*f*).

Thereafter, the connecting member 102*a* is released so that connection between the driving motor 122 and the tray 101 is removed and after being released from the positional fixation, the tray 101 carrying the treated package P is transported to a subsequent process by a conveyor and a new tray carrying a package to be freshly treated is introduced to the system. Thus, a series of operational steps are terminated.

Although the above explanation is for an embodiment in which a package has a yarn end fixed by entanglement with the outermost layer yarn, the present invention is also applicable to a package on which a yarn end is fixed by a knot if a wound yarn portion containing the same is maintained in a slack state. Note that the cutter may be an electric cutter, a hot air cutter or the like in place of the mechanical cutter, in which a scissor and a knife edge are actuated by a power cylinder or a spring. Further, the yarn detector may be of any type including a non-touch type and a touch type, in place of an optical detector.

The package revolving mechanism should not be limited to this embodiment, but may comprise any connecting and driving system.

As stated above, according to one aspect of the present invention, superior effects are obtainable in that a yarn end can be assuredly and rapidly fixed on a package, by which disordered yarn ends during package transportation can be eliminated without adversely influencing product quality, and can be easily picked up during a peel-off operation of the package outer layer. According to another aspect of the present invention, a yarn end fixed on a package can be easily, rapidly and assuredly released to that automation of the package treatment is effectively attainable.

We claim:

1. A method for picking up a yarn end so as to fix the same on a yarn package, comprising the following steps:

picking up a yarn end from a yarn package by a suction means so as to hold said end yarn therein in a drawn state, inserting a yarn end handling bar between the held yarn end and the package surface, revolving the yarn end handling bar along the package surface while maintaining the bar beneath an outermost layer yarn connected to the yarn end, until a layered portion is formed, in which the yarn end held in a drawn state, which coincides with the outermost yarn layer, and ejecting a jet of pressurized fluid onto or in the vicinity of the layered portion so as to entangle the yarn end with the outermost yarn layer so that the yarn end is fixed on the package.

2. A method for picking up a yarn end so as to fix the same on a yarn package as defined by claim 1, further comprising the following step:

ejecting a jet of pressurized fluid onto the entangled portion, in which the yarn end is entangled with the outermost yarn layer when the package is removed from a bobbin holder; the jet being ejected in the same direction as the removing direction of the package.

3. An apparatus for picking up a yarn end so as to fix the same on a yarn package, comprising a bobbin holder for holding a yarn package and connected to a driving means for rotating the bobbin holder together with the yarn package;

a yarn end holding bar arranged parallel to the bobbin holder and adapted to be capable of revolving around the bobbin holder by a driving means so that an outermost yarn layer of the package held by the bobbin holder is partly separated from the package surface so as to form a layered portion with the yarn end;

a suction means associated with the bobbin holder for picking up the yarn end from the package surface and holding the same in a drawn state; and a fluid treatment means movable in the direction closer to and away from the bobbin holder, for entangling and fixing the yarn end with the outermost yarn layer separated from the package surface.

4. An apparatus for picking up a yarn end so as to fix the same on a yarn package as defined by claim 3, wherein the yarn end holding bar is movable in a direction closer to and away from the bobbin holder.

5. An apparatus for picking up a yarn end so as to fix the same on a yarn package as defined by claim 3, wherein the yarn end holding bar comprises a pair parallel rods.

6. An apparatus for picking up a yarn end so as to fix the same on a yarn package as defined by claim 3, wherein the yarn end holding bar has at least one groove for guiding a yarn.

7. An apparatus for picking up a yarn end so as to fix the same on a yarn package as defined by claim 3, wherein the fluid treatment means is an entanglement nozzle.

* * * * *